US010632035B1

(12) United States Patent
Kelsey et al.

(10) Patent No.: US 10,632,035 B1
(45) Date of Patent: Apr. 28, 2020

(54) DEVICE FOR RECEIVING A SURRENDERED BABY

(71) Applicant: Safe Haven Baby Boxes, Inc., Woodburn, IN (US)

(72) Inventors: Monica Kelsey, Woodburn, IN (US); Joseph Floyd Kelsey, Woodburn, IN (US)

(73) Assignee: SAFE HAVEN BABY BOXES, INC., Woodburn, IN (US)

( * ) Notice: Subject to any disclaimer, the term of this patent is extended or adjusted under 35 U.S.C. 154(b) by 0 days.

(21) Appl. No.: 16/429,597

(22) Filed: Jun. 3, 2019

(51) Int. Cl.
*G08B 13/08* (2006.01)
*A61G 11/00* (2006.01)
*G08B 21/22* (2006.01)

(52) U.S. Cl.
CPC ..... *A61G 11/005* (2013.01); *G08B 21/22* (2013.01)

(58) Field of Classification Search
CPC ..... A61G 11/005; G08B 21/22
USPC ..... 340/545.1
See application file for complete search history.

(56) References Cited

U.S. PATENT DOCUMENTS 4,773,392 A * 9/1988 Koch ..... A61G 11/00 600/22
5,810,709 A * 9/1998 Simenauer ..... A61G 11/00 600/22
6,554,343 B2 * 4/2003 Sugiyama ..... B60N 2/283 296/68.1
6,823,547 B1 11/2004 Harding et al.
8,042,204 B2 * 10/2011 Kavounas ..... A47D 7/007 5/93.1
8,292,798 B2 10/2012 Californniaa
8,448,858 B1 5/2013 Kundu et al.
9,056,039 B1 6/2015 Californniaa
D769,026 S 10/2016 Weiss et al.
(Continued)

FOREIGN PATENT DOCUMENTS

CN 204360513 U * 5/2015
DE 102008031223 A1 * 1/2010 ..... A61G 11/00

OTHER PUBLICATIONS

Bartsch, Matthias, et al,. "Do Baby Hatches Save Lives?" Speigel online http://www.speigel.de/international/germany/controversy-over-baby-hatch, dated Jul. 13, 2012 (7 pages).
(Continued)

*Primary Examiner* — Naomi J Small
(74) *Attorney, Agent, or Firm* — Maginot, Moore & Beck, LLP

(57) ABSTRACT

A system for surrendering a baby includes a receptacle defining a space large enough to contain a baby. The receptacle includes a front located on an exterior wall of a building and an opposing back accessible from the interior of the building. An exterior door is arranged in the front and a second door is located in the back and sized to allow a baby to pass out of the receptacle. The system includes a multi-level alarm system arranged to activate when the baby is placed in the receptacle, the multi-level alarm system including a first alarm that is actuated upon opening of the exterior door and a second alarm that is actuated when the baby is placed in a medical bassinet located in the receptacle. When the exterior door is opened the first alarm sounds and when the baby is placed in the medical bassinet the second alarm sounds.

14 Claims, 6 Drawing Sheets

(56) References Cited

U.S. PATENT DOCUMENTS

| | | | | |
|---|---|---|---|---|
| D813,571 | S | 3/2018 | Weiss et al. | |
| 10,134,258 | B2 | 11/2018 | Chacon, Jr. et al. | |
| 10,157,529 | B2 | 12/2018 | Rubinstein | |
| 2002/0138016 | A1* | 9/2002 | Wilson ..... | A61B 5/0806 600/534 |

OTHER PUBLICATIONS

Asai, Atsushi and Ishimoto, Hiroko, "Should We Maintain Baby Hatches in Our Society?" BMC Med Ethics 2013: 14:9, dated Feb. 22, 2013 (7pages).
Baby Hatch Wikipedia article (5 pages).
German Daily Mail.com article regarding Baby Hatches dated Jan. 9, 2019 (41 pages).

* cited by examiner

DEVICE FOR RECEIVING A SURRENDERED BABY

BACKGROUND

The present disclosure relates to devices arranged and constructed to accept surrenders of babies. More particularly, the present disclosure relates to a secured environmentally controlled device for the safekeeping of babies when surrendered at locations for retrieval by first responders.

Historically, a baby hatch or baby box is a place where people (typically mothers) can bring babies, usually newborn, and abandon them anonymously in a safe place to be found and cared for by someone other than the person who abandoned the baby. This kind of arrangement was common in the Middle Ages, when the device was known as a foundling wheel. A foundling wheel was a cylinder set upright in the outside wall of the building, and operated similar to a revolving door. Mothers could place the baby in the cylinder, turned it around so that the baby was inside the church, and then rang a bell to alert caretakers.

From the late 1100s, the first foundling wheels were used in Italy. Pope Innocent III decreed that these should be installed in homes for foundlings so that women could leave their baby in secret instead of killing them, a practice clearly evident from the numerous drowned infants found in the Tiber River. Foundling wheels were taken out of use in the late 19th century but a modern form, the baby hatch, began to be introduced again sometime in the 1950s and now are used to some extent in many countries, including Germany, Pakistan.

Generally, the hatches may be located in hospitals, social centers, fire departments, police stations, or churches, depending on the country of location. The hatches consist of a door or flap in an outside wall which opens onto a soft bed, heated or at least insulated. Sensors in the bed are used to alert caregivers when a baby has been put on the bed so that they can come and take care of the baby.

The first modern baby hatch was in South Africa in July 1999 and was installed by Door of Hope Children's Mission (Hole in the Wall) at a small mission church in Berea in Johannesburg. In 1999 the pastor, Cheryl Allen, and deacons learned with deep distress that a high number of newly born infants were abandoned. Pastor Allen realized that many of those desperate women and girls may well have acted differently if there had been an alternative. The church made a hole in their wall and a "baby bin" was installed allowing for mothers to leave their babies any time, day or night.

The moment a baby is placed on the bed in the "baby bin," care workers on duty receive an electronic signal alerting them. The baby is taken in and the anonymity of the "donor" ensured. Baby M was the first baby that came through the "baby bin", arriving on 3 Oct. 1999. The second modern baby hatch in Germany was installed in the Altona district of Hamburg in April 2000, after a series of cases in 1999 where children were abandoned and found dead from exposure. It consisted of a warm bed in which the baby could be placed from outside the building. After a short delay to allow the person who left the baby to leave anonymously, a silent alarm was set off which alerted staff.

In the past, a main reason many babies were surrendered was they were born out of wedlock. Today, baby hatches are more likely used by mothers who are in crisis for any number of reasons. For example, the mother may lack sufficient resources to care for the child, or the mother may be at a point in her life where she believes she is too old or too young to care for a baby. They want to surrender the baby to someone who is able to care for the baby, but do not wish to divulge their identity. In some countries, it is not legal for mothers to give birth anonymously in a hospital, and the baby hatch is the only way they can safely and secretly leave their baby to be cared for by others.

One of the shortcomings of existing systems is the lack of backup alarms to alert potential care givers that a baby has been left in the device. If the sensor fails, then a baby could be placed in the device and left there for an extended period of time before being discovered by a caregiver, thus endangering the health of the baby. Another shortcoming of existing systems is they are limited to locations that are staffed 24 hours a day so as to ensure there is always a caregiver available to retrieve and care for a baby left in the device.

What is needed is a system with multiple redundancies to ensure a caregiver is notified when a baby is placed in the device. What is also needed is a device that can be located in a building that is not necessarily staffed 24 hours/day, but can be quickly accessed by first responders from nearby locations when a baby is placed in the device. Embodiments of the present disclosure solve these and other problems with existing devices.

SUMMARY OF THE INVENTION

The system for anonymously receiving a baby of the present disclosure includes a receptacle having a front and an opposing back, the receptacle defining a space at least large enough to contain a baby. An exterior door is arranged in the front and sized to allow the baby to pass through the exterior door into the space. The system also includes a lock constructed for locking the exterior door and a second door arranged in the back that allows access to the receptacle from an interior of a building. The second door is sized to allow a baby to pass through the second door into the building. The second door includes at least one ventilation opening for providing conditioned air to the receptacle from the building. A baby receiving area is located in the receptacle between the front and the back.

The system for anonymously receiving a baby of the present disclosure further includes a multi-level alarm system for notifying an alarm monitor that the baby is in the receptacle, the multi-level alarm system includes a first alarm that is actuated upon opening of the exterior door and a second alarm that is actuated when the baby is placed in the baby receiving area. At least one of the alarms is controlled via an ECU. When the exterior door is opened the first alarm sounds until the exterior door is closed and when the baby is placed in the baby receiving area the second alarm sounds. When the exterior door is closed after the baby has been placed in the baby receiving area, the exterior door locks and cannot be opened until the baby is removed from the baby receiving area.

The system for anonymously receiving a baby of the present disclosure further includes a medical bassinet located in the baby receiving area wherein the second alarm includes an optical sensor system that projects a beam of light through the medical bassinet such that when the baby is placed in the medical bassinet, the beam of light is interrupted causing the second alarm to actuate. The system for anonymously receiving a baby of the present disclosure further includes a visual alarm located in the interior of the building such that when the exterior door is opened and the visual alarm is activated, the visual alarm cannot be observed from the exterior door.

DETAILED DESCRIPTION

Figure 2:
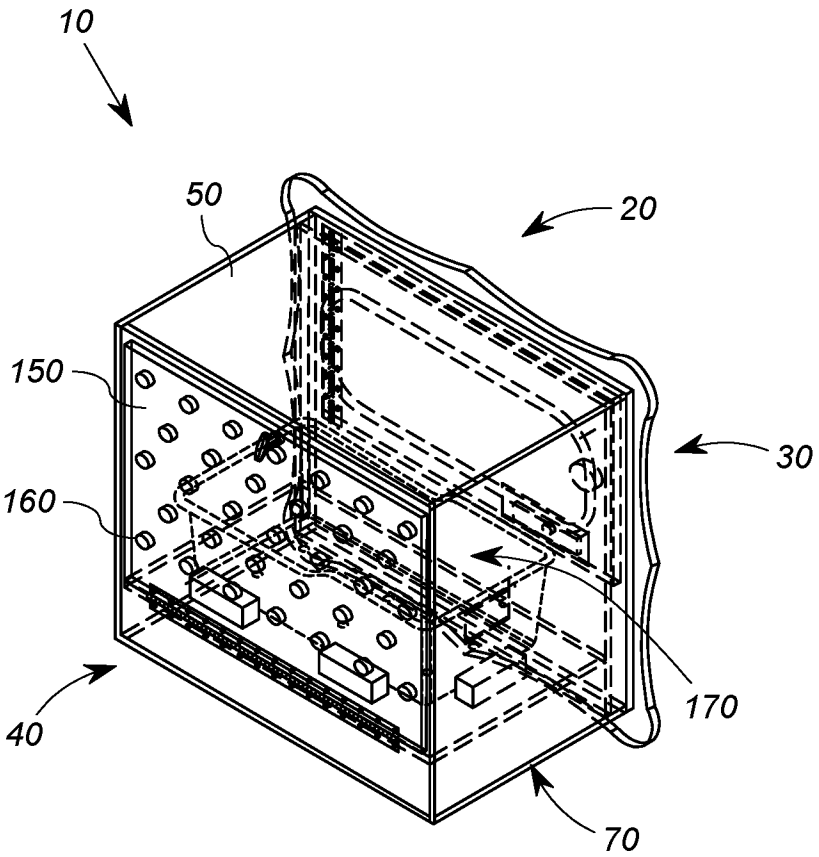
FIG. 2 is a rear-facing non-limiting perspective view of the device according to one aspect of the present disclosure.
Figure 1:
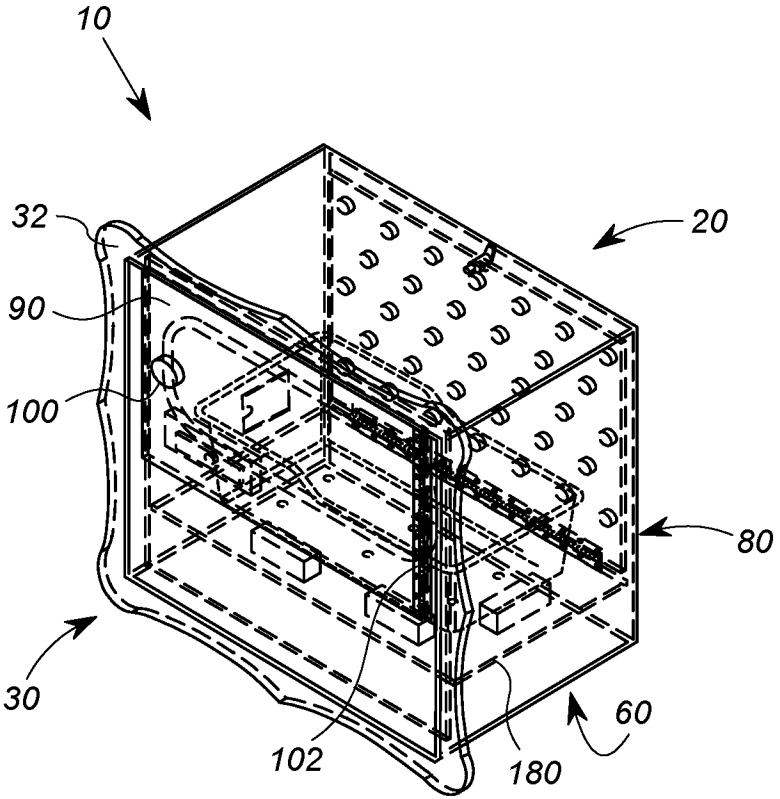
FIG. 1 is a non-limiting front-facing perspective view of the device according to one aspect of the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Newborn usually refers to a child from birth to about 2 months of age. Infants can be considered children anywhere from birth to 1 year old. Baby can be used to refer to any child from birth to age 4 years old, thus encompassing newborns, infants, and toddlers.

Now referring to FIGS. 1-7, an embodiment of the device 10 for anonymously accepting a surrendered baby 1 is arranged and constructed to be installed in a building 14 that includes an interior 18 of building 14. Building 14 further includes multiple outside walls 12, a roof, a foundation and floors as is typical and necessary to complete a particular building for a particular purpose.

The device 10 for anonymously accepting a surrendered baby 1 includes a substantially rectangular receptacle 20 defining a space at least large enough to contain a baby. The receptacle 20 includes a front 30, an opposing back 40, a top 50, a bottom 60, a first side 70, and an opposing second side 80. The front includes a front fascia 32 defining the outer perimeter of the front 30. An opening 34 is defined in the front 30 and is sized to allow the baby 1 to pass into the receptacle 20. The receptacle is constructed to be mounted through a wall 12 of a building 14 with the front 30 displayed on the outside 16 of the building 14 and the back 40 of receptacle 20 accessible from the inside 18 of the building 14.

The device 10 further includes an exterior door 90 arranged in the front 30, the exterior door 90 having a handle 100 and a hinge 102. Handle 100 may be a latching handle to ensure that when the exterior door is closed it remains closed unless the handle 100 is actuated to open the exterior door. The hinge 102 may be a continuous hinge, such as a piano hinge that is properly sized for the exterior door 90. In other embodiments, the hinge 102 may comprise multiple hinges appropriately spaced on an edge of the exterior door 90. However, any suitable hinge or group of hinges may be used as long as the exterior door 90 is arranged to open up enough to allow the baby to pass into the receptacle 20. The exterior door 90 may be insulated or not depending on where a particular device 10 is installed. The insulation may include an insulating strip 92 mounted on the front 30 along the perimeter of opening 34. However, insulation may also be installed in or on exterior door 90.

The device further includes a lock 110 for locking the exterior door as will be discussed in more detail below. In one embodiment the lock 110 comprises an electromagnetic lock. The electromagnetic lock consists of an electromagnet 120 and a corresponding armature plate 130. In one embodiment the electromagnet 120 is attached to a frame of the exterior door 90. The mating armature plate 130 is attached to the exterior door 90. The electromagnet 120 and the armature plate 130 are in contact when the exterior door 90 is closed. When the electromagnet 120 is energized, a current passing through the electromagnet 120 creates a magnetic flux that causes the armature plate 130 to attract to the electromagnet 120, creating a locking action. In other embodiments, one of ordinary skill in the art would understand that other types of locks and locking systems may be used to secure the exterior door 90.

The device further includes a second door 150 arranged roughly opposite the exterior door 90. In one embodiment, the second door 150 opens into the inside 18 of building 14. The second door includes a second door handle 152 that includes a latch mechanism to keep the second door in the closed position when not opened. The second door 150 is arranged and sized to allow a first responder or another caregiver to remove the baby 1 from the receptacle 20 through the second door 150. The second door 150 is preferably constructed of a transparent or semi-transparent material such that a first responder or other care provider can see into the receptacle 20 and visually determine if a baby 1 is in the receptacle. Second door 150 may be constructed with at least one ventilation opening 160 and preferably, multiple ventilation openings 160. The ventilation openings 160 allow conditioned air, which may be either heated or cooled, from the inside 18 of the building 14 to flow through ventilation openings 160 into the receptacle 20.

Figure 3:
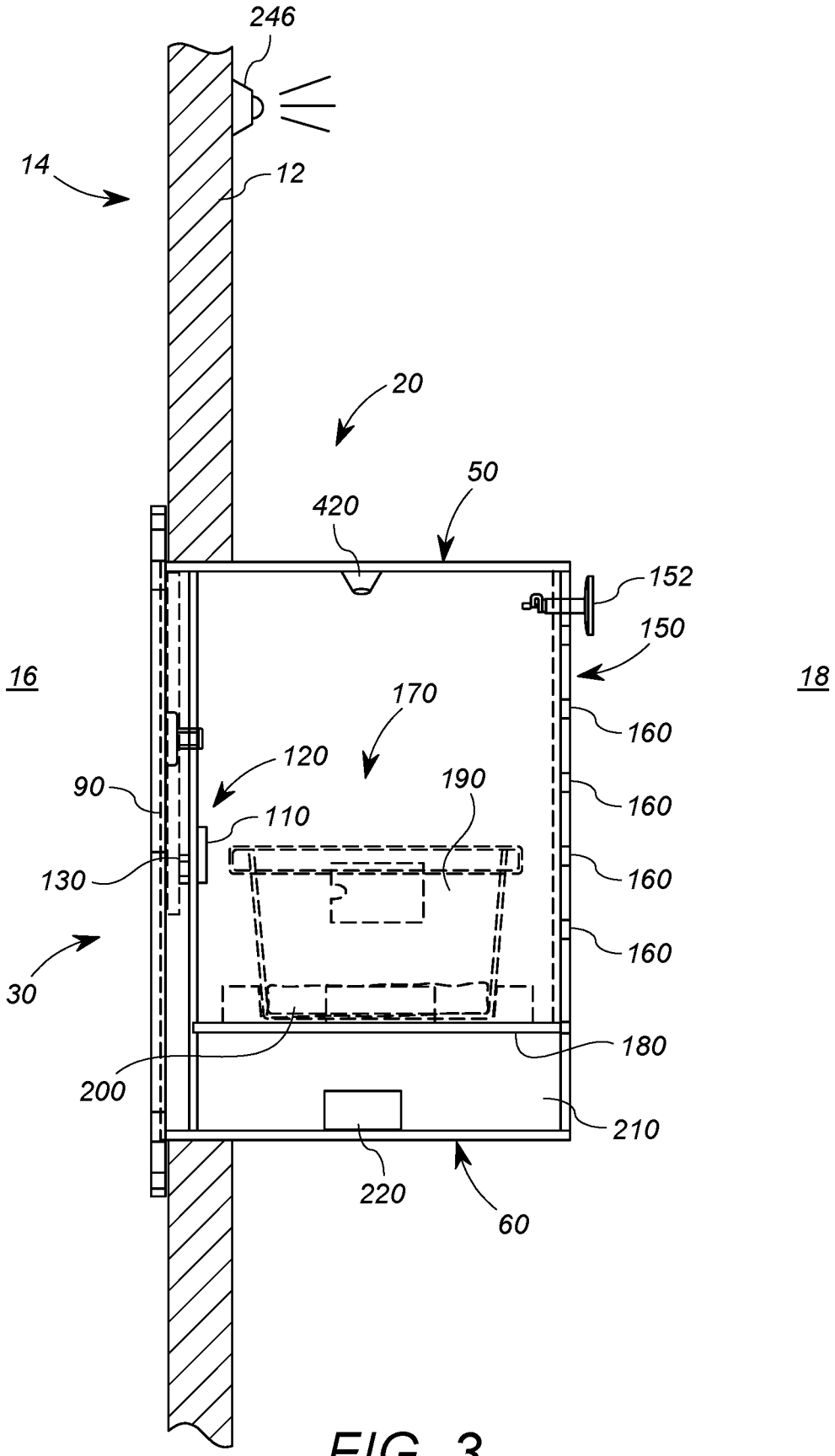
FIG. 3 is a non-limiting side view of the device according to one aspect of the present disclosure.
Figure 4:
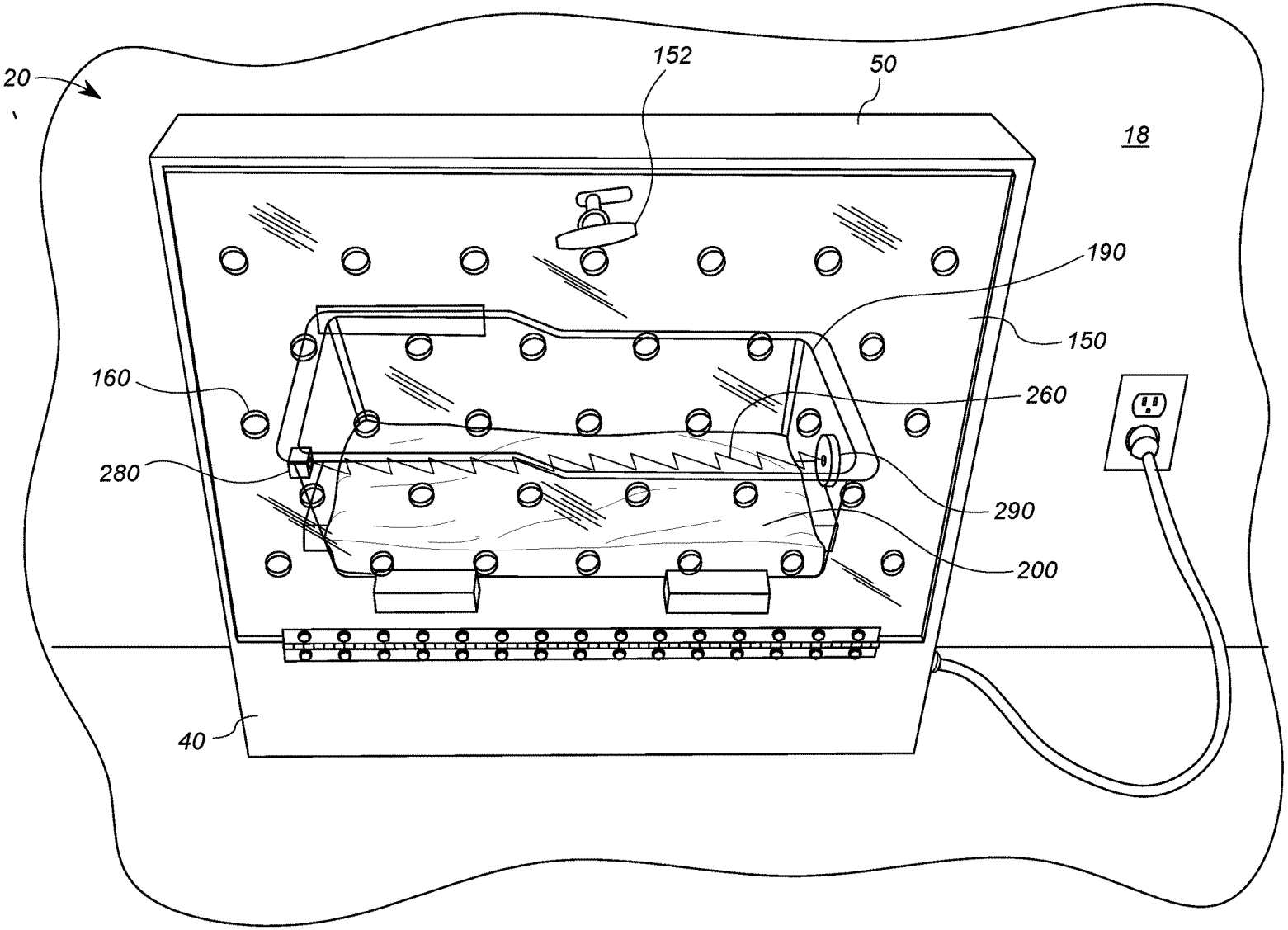
FIG. 4 is a non-limiting view of the back of the device according to one aspect of the present disclosure.
Figure 5:
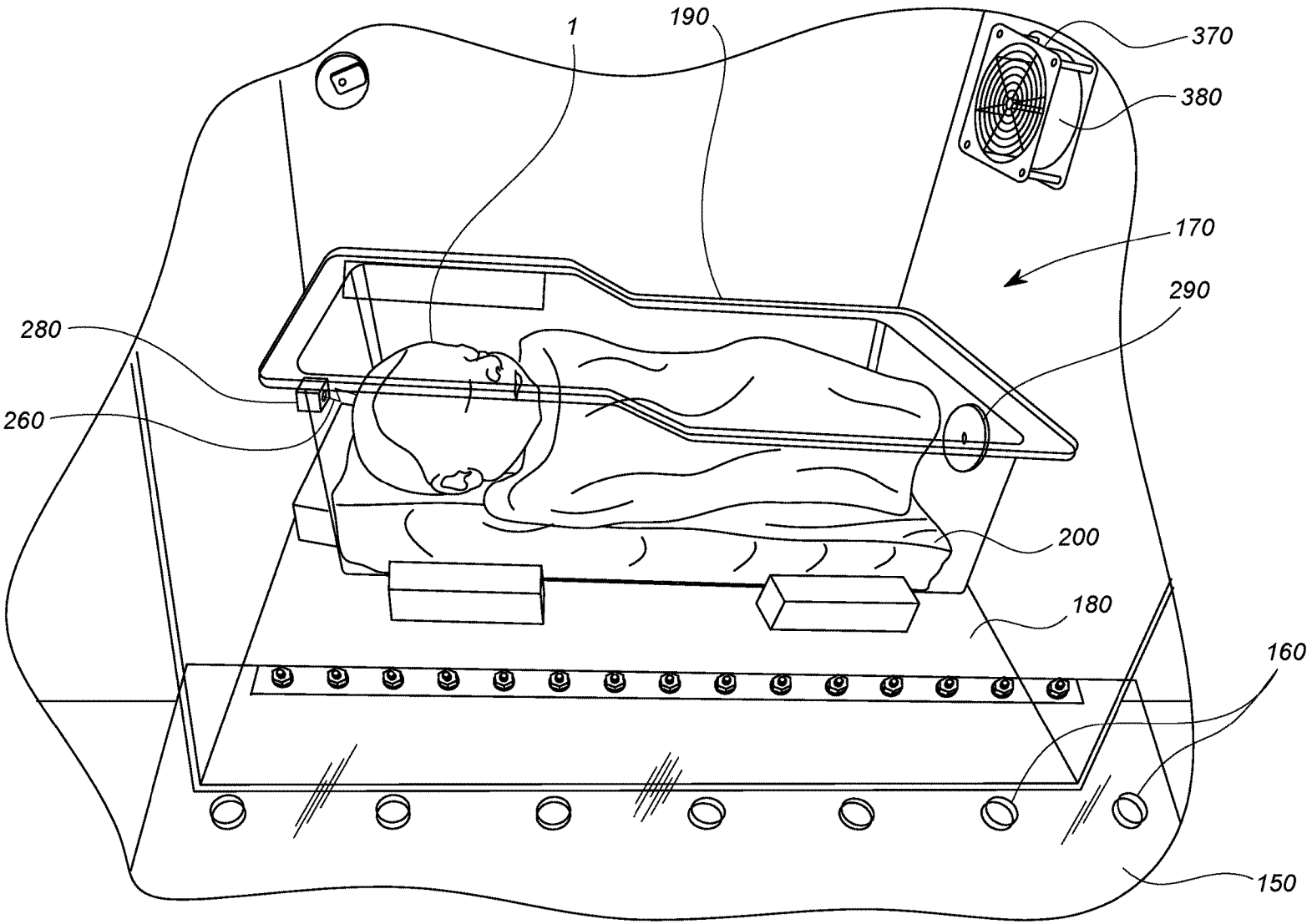
FIG. 5 is another non-limiting view of the device containing a baby according to one aspect of the present disclosure.
Figure 6:
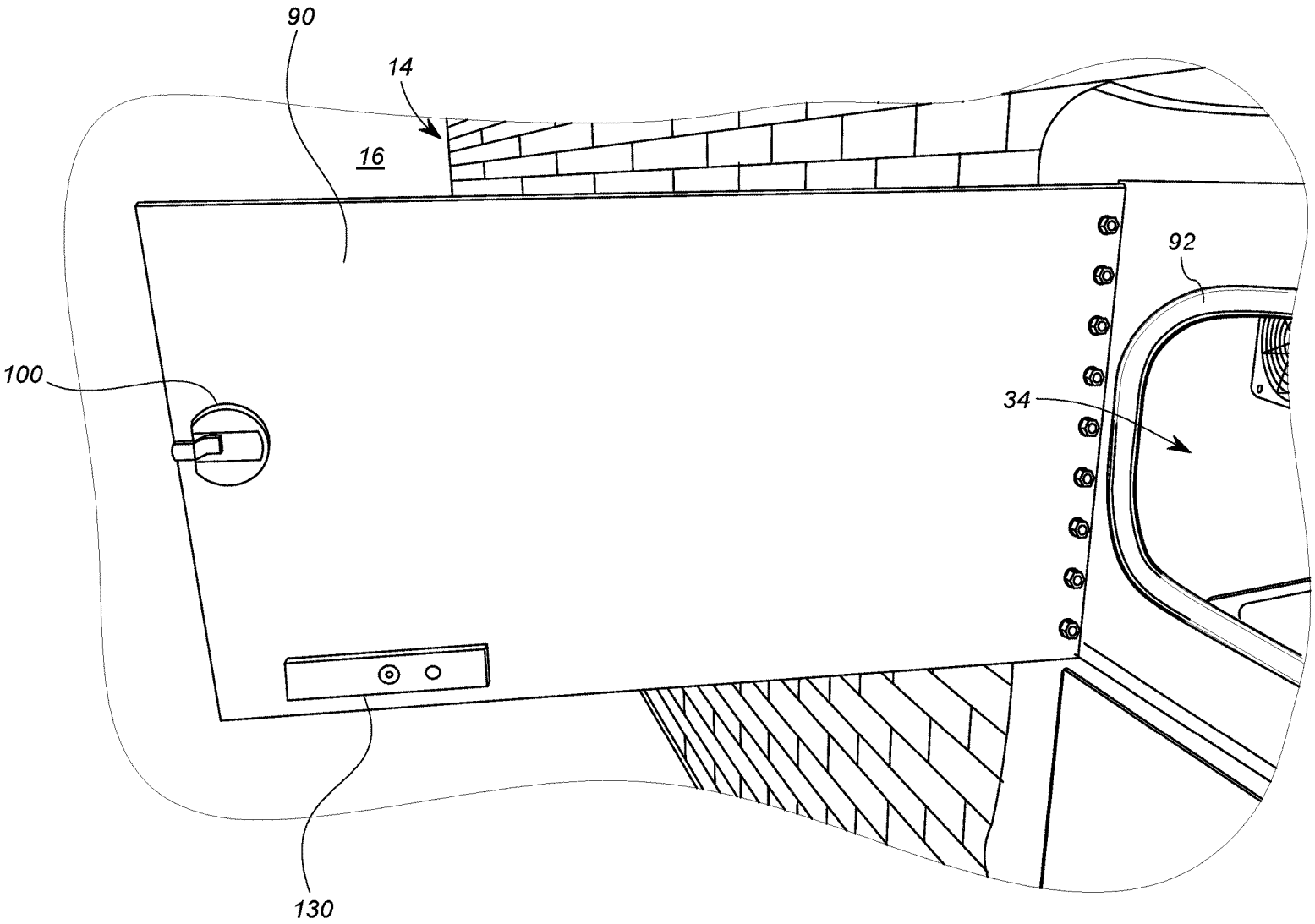
FIG. 6 is a non-limiting view of the details of the device as viewed from the front according to one aspect of the present disclosure.
Figure 7:
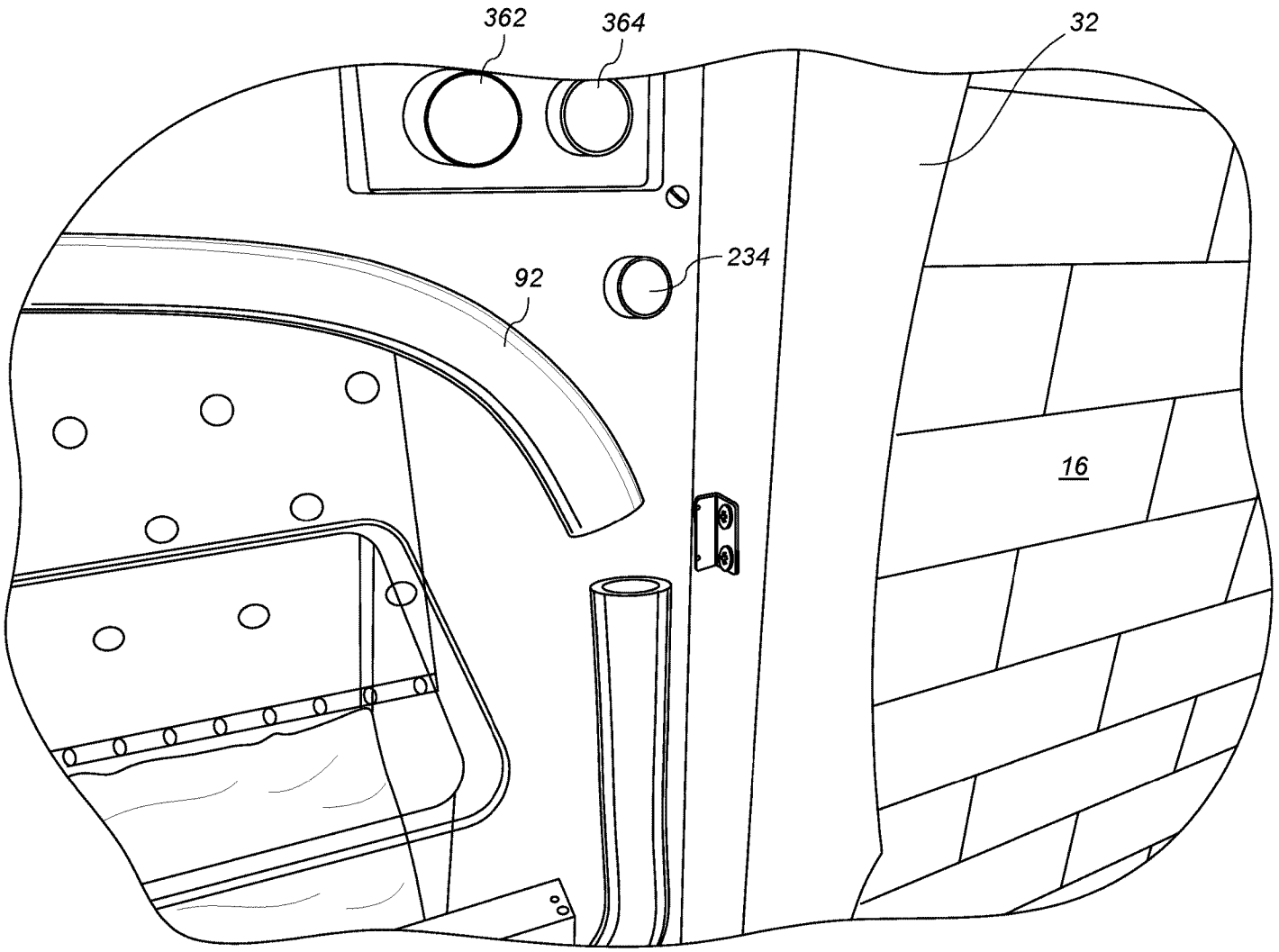
FIG. 7 is another non-limiting view of the device as viewed from the front showing additional details according to one aspect of the present disclosure.

Referring to FIGS. 3, 4 and 5, an embodiment of the present disclosure includes a baby receiving area 170 located in receptacle 20 between the front 30 and the back 40. In one embodiment of the present disclosure, the baby receiving area 170 may include a floor or platform 180 that is support above the bottom 60 of receptacle 20. One embodiment of the present disclosure includes a bassinet 190 arranged on the floor 180. In one embodiment, the bassinet 190 is a medical bassinet. The bassinet may be constructed of any material suitable of its intended purpose. Preferably the bassinet 190 is constructed of a material that will allow a beam of light to travel through the material. The bassinet 190 may include a soft yet supportive liner, such as a mattress 200, arranged on the platform 180. Another embodiment may not include a bassinet, but only a mattress 200. Mattress 200 may include a means for providing heat that may be controlled so as not to provide too much heat for the baby.

One embodiment of the present disclosure includes an electronics bay 210, which may be located below the platform 180. However, one of ordinary skill would understand that the electronics bay may be located in any suitable location within the receptacle 20 or outside of receptacle 20.

The electronics bay includes the electronics required to monitor and control the device of the present disclosure. For example, one embodiment includes an Electronics Control Unit ("ECU") 220 located in electronics bay 210 while another embodiment (not shown) includes an ECU located outside of the electronics bay.

One embodiment of the present disclosure includes a multilevel alarm system 230. The multilevel alarm system 230 may be a hardwired system, meaning the alarms are hardwired into the location of the device 10. In another embodiment of the present disclosure, the multilevel alarm system 230 may be a wireless system meaning one or more alarms are wirelessly connected to the location of the alarm monitor. In other embodiments, the wireless system may also include wireless connectivity between the various sensors and ECU 220. In other embodiments of the present disclosure, the wireless connectivity may be direct between sensors and the alarm monitor. Still other embodiments may include a combination of hardwired connections and wireless connections.

The multilevel alarm system 230 may include a first alarm 232 which is activated when the exterior door 90 is opened and remains activated until the exterior door is closed. An exterior door sensor 234, located in close proximity to the inside of the exterior door 90 when it is closed, may comprise a magnetic proximity switch. The exterior door sensor/magnetic proximity switch 234 is a part of the exterior door status circuit 240. When the exterior door 90 is closed, the proximity switch 234 opens the exterior door status circuit 240 and when the exterior door is opened, the proximity switch 234 closes the exterior door status circuit. When the exterior door 90 is open, the exterior door status circuit 240 is closed allowing exterior door sensor 234 to send an "exterior door open" signal 236 to the ECU 220 indicating the exterior door 90 is open. The ECU includes software code 238 that causes a first alarm signal 242 to be sent to an alarm monitor 244, thereby notifying the alarm monitor that the exterior door 90 has been opened. An alarm monitor is the organization or person monitoring the alarms of the device 10. Examples of alarm monitors include but are not limited to an alarm monitoring company, a 911 dispatch office, fire station dispatch office, police station dispatch office, a security dispatch office, any person located at the building 14 or other remote location responsible for monitoring the alarms described herein. The software code 238 may include code that creates a predetermined delay before sending the first alarm signal 242 to the alarm monitor 244. Once the exterior door 90 closes, the circuit opens, thus terminating the exterior door open signal 236 from the sensor 234 to ECU 220 and terminating the first alarm signal 242 to the alarm monitor.

In another embodiment of the present disclosure, a light 246 is constructed to turn on when exterior door 90 is opened. Light 246 may serve as another alarm to notify first responders/care givers located at the site of device 10 that exterior door 90 is open. Light 246 may be located on the inside 18 of building 14 in any convenient location. For example, and without limitation, light 246 may be located in close proximity to receptacle 20 such that when the exterior door 90 is open and light 246 is on, the light emitted cannot be seen by the individual surrendering the baby 1, but is readily seen by someone located in building 14. Another non-limiting example of locations for light 246 may include a break room at a hospital or police station or an engine bay, break room or sleeping quarters at a fire station.

Light 246 may be arranged to turn on and off under multiple conditions, as appropriate for a particular location and situation as would be understood by one of ordinary. As previously discussed, light 246 may be constructed to turn on upon opening of exterior door 90. Light 246 may be also arranged to turn on when a baby 1 is placed in the bassinet 190. Light 246 may be either turned on via a direct wired or wireless connection to the exterior door sensor 234 or other sensor or via the combination of sensor 234, ECU 220 and appropriate software code loaded on ECU 220. In other embodiments, the light 246 may be turned off manually upon removal of the baby from the receptacle via second door 150 or automatically when the baby is removed from the bassinet in connection with the second alarm 250 as discussed below.

The multilevel alarm system 230 further includes a second alarm 250 that is activated when the baby is placed in the baby receiving area 170. In one embodiment of the present disclosure, the second alarm 250 is activated when a beam of light 260 is interrupted by the baby being placed in the baby receiving area and, more particularly, as the baby is being placed in the bassinet 190. In one embodiment of the present disclosure, the second alarm 250 may be activated via an optical sensor system 270. Such a system may include a retro reflective photo eye 280 mounted in the receptacle 20 with a reflector 290 aligned with the retro reflective photo eye 280 and mounted in the receptacle 20 opposite the retro reflective photo eye. Photo eye 280 also serves to emit beam of light 260. The beam of light 260 extends between the retro reflective photo eye 280 and reflector 290 and passes through the bassinet 190.

When the baby 1 is placed in the baby receiving area 170, which may include medical bassinet 190, the beam of light 260 is interrupted. Interrupting the beam of light closes a second circuit 300 causing a "beam interruption" signal 310 to be sent to the ECU 220. Once the ECU receives the "beam interruption" signal 310, multiple actions may follow. One such action may include energizing the electromagnet 120 in preparation for the closing of exterior door 90. Thus, once a baby has been detected via interruption of the beam of light 260, the electromagnet 120 is energized such that when the exterior door 90 is closed, exterior door 90 becomes locked.

In one embodiment of the present disclosure, another action that may be occur after the ECU 220 receives the "beam interruption" signal 310 is a "baby present" signal 320 is sent to the alarm monitor 244. ECU 220 may include second alarm software code 330 that includes a variable delay code 340 that causes the "baby present" signal 320 to be sent to the alarm monitor 244 after a predetermined delay 350. One purpose of the predetermined delay 350 is to increase the likelihood that a first responder will not retrieve the baby 1 prior to surrendering of the baby has been completed. Predetermined delay 350 may be set for any time delay that is appropriate for a particular location of device 10. For example, the predetermined delay 350 may be dictated by a state statute. The predetermined delay 350 can be seconds long or many minutes as appropriate.

Once the baby 1 has been placed in the baby receiving area 170 and preferably in bassinet 190, as discussed above, the beam of light 260 is interrupted causing the electromagnet 120 to be energized. Once the exterior door 90 closes, the energized electromagnet 120 creates a strong magnetic attraction to armature plate 130, thus locking exterior door 90. As long as the baby 1 remains in the baby receiving area 170, the beam of light 260 will continue to be interrupted and the exterior door 90 will continue to be locked.

Once the baby is removed from the bassinet 190, the beam of light 260 will once again span the area between the photo eye 280 and the reflector 290. This results in a signal sent to the ECU 220. Code within the ECU causes electromagnet 120 to de-energize resulting in unlocking of exterior door 90. At this time, the baby present signal 320 is cleared and the multilevel alarm system is essentially reset and ready for the next placement of a baby in the device 10. In some embodiments, when the baby present signal 320 is cleared, ECU 220 sends a signal resulting in light 246 turning off.

In one embodiment of the present disclosure, device 10 includes a lighted button 360 located near exterior door 90. In one embodiment, the lighted button 360 may be a button and light combined into a single unit. In other embodiments, the light 362 and button 364 may be separate structures. The light 362 and corresponding button 364 serve as another means of notifying first responders or caregivers that a baby has been placed in the baby receiving area 170.

Associated with the light/button 362/364, may be signage directing the individual placing the baby 1 in the baby receiving area 170 of device 10 to push the button 364 after placing the baby in the baby receiving area. Once the button 364 is pushed, a signal 366 is sent to the ECU 220. Code in the ECU 220 acts to turn off the light, whether it is the light 362 or light in lighted button 360. The ECU 220 may also include code to send a signal to the alarm monitored that the button 364 has been pushed. Another purpose of the light/button is to provide a placebo effect for the individual placing the baby in the device 10 to reinforce the fact that the baby is being surrendered. Additionally, pushing of the button 364 provides proof that the individual surrendering the baby is consenting to the surrender. The individual not only places the baby in the device, but affirmatively takes an action, i.e., pushing the button, to notify someone that the individual has surrendered the baby to someone else's care and affirmatively consents to that surrender.

In one embodiment of the present disclosure, device 10 includes a fan 370 and a heater 380 mounted in receptacle 20. The fan 370 may run continuously or may cycle on and off depending on the location of device 10. The heater 380 may be controlled by ECU 220 or may include its own controller, which may be part of the controller located in the heater or may be separate from the heater, but not part of the ECU.

In one embodiment of the present disclosure, a thermostat 390 may be used to monitor the temperature in the receptacle 20 and will be used by the controller or ECU to determine when to turn on and turn off the heater 380. The thermostat 390 may be located in any appropriate location within the receptacle 20 that ensures accurate temperature monitoring of the environment surrounding the surrendered baby. The heater 380, whether controlled by the ECU 20 or a separate controller, may be programmed to turn on at a predetermined temperature 400. For example, the heater 380 could be programmed to turn on once the internal temperature of receptacle 20 falls below 76 degrees F. The heater 380 may also be programmed to turn off when the temperature in the receptacle exceeds a second predetermined temperature 410, such as for example 79 degrees F. The first and second predetermined temperatures may be selected to be any appropriate temperature, as would be understood by one of ordinary skill in the art.

Referring to FIG. 3, one embodiment of the present disclosure includes video monitoring of the baby receiving area 170. An infrared low light camera 420 is mounted inside of receptacle 20 on or near the top 50 of receptacle 20. Camera 420 is positioned such that its field of view is limited to the baby receiving area 170 and does not include any view past the interior of receptacle 20, such that the camera cannot record the identity of the person placing the baby in the baby receiving area 170. In one embodiment of the present disclosure, the camera 420 is turned on and begins recording when exterior door 90 is opened and continues to record until the baby 1 is removed from the baby receiving area 170.

However, recording by video camera 420 can begin and end at other times during the process of using device 10 depending on the location of device 10 and the particular circumstances of its use. For example, in one embodiment, recording by video camera 420 may begin when beam of light 260 is interrupted by the baby 1 when the baby is placed in bassinet 190 and ended when the baby 1 is removed from bassinet 190 and beam of light 260 integrity is restored.

Control of video camera 420 may be accomplished via ECU 220. For example, in one embodiment of the present disclosure, when the exterior door 90 is open, the exterior door status circuit 240 is closed allowing exterior door sensor 234 to send an exterior door open signal 236 to the ECU 220 indicating the exterior door 90 is open. The ECU 220 may include software code 430 that causes a signal to be sent to video camera 420 that turns on the video camera so that it begins to record. This action would roughly correspond to the first alarm signal 242 being sent to the alarm monitor. Video camera recording may be terminated when the baby is removed from bassinet 190 as discussed in more detail below, or may be terminated by the alarm monitor sometime after the exterior door 90 closes. Termination of recording may also be based on opening of the second door/interior door 150 and/or removal of the baby through second door 150.

In another embodiment of the present disclosure, video camera 420 may be controlled by ECU 220 based on placement and removal of the baby from bassinet 190. When the baby 1 is placed in the baby receiving area 170, which may include medical bassinet 190, the beam of light 260 is interrupted. Interrupting the beam of light closes a second circuit 300 causing a "beam interruption" signal 310 to be sent to the ECU 220. Once the ECU receives the "beam interruption" signal 310, software code may cause multiple actions including sending a "turn on video camera" signal 430 to video camera 420 to turn on and begin recording.

Once the baby is removed from the bassinet 190, the beam of light 260 will once again span the area between the photo eye 280 and the reflector 290, a "baby removed from bassinet" signal 440 is sent to the ECU 220. ECU 220 includes code 450 that causes a "turn off video camera" signal 460 to be sent to the video camera 420 in response to receiving the "baby removed from bassinet" signal 440. Recordings may be saved in any manner as understood in the art, including download to the cloud or server or other device as would be understood by one of ordinary skill.

It should be understood, that relative positional terms such as, "front, "back," "left," "right," "top," "bottom," and the like, are with reference to the normal operational position of the device disclosed herein with respect to its normal intended use in providing a safe and secure environment for anonymously abandoning a baby. Such positional terms should not be considered otherwise limiting.

The present invention has been described in an illustrative manner. It is to be understood that the terminology that has been employed herein is intended to be in the nature of words of description rather than word of limitation. While there have been described herein what are considered to be exemplary embodiments of the present invention, other modifications of the invention shall be apparent to those skilled in the art from the teachings herein and, it is, therefore, desired to be secured in the appended claims all such modification as fall within the true spirit and scope of the invention.

We claim:

1. A system for receiving a baby, comprising:

a receptacle having a front and an opposing back, the receptacle defining a space at least large enough to contain a baby;

an exterior door arranged in the front and sized to allow the baby to pass through the exterior door into the space;

a lock constructed for locking the exterior door;

a second door arranged in the back that allows access to the receptacle from an interior of a building, the second door sized to allow a baby to pass through the second door into the building, the second door having at least one ventilation opening for providing conditioned air to the receptacle from the building;

a baby receiving area located between the front and back;

a multi-level alarm system for notifying an alarm monitor that the baby is in the receptacle, the multi-level alarm system including a first alarm that is actuated upon opening of the exterior door and a second alarm that is actuated when the baby is placed in the baby receiving area; and an ECU for controlling at least one of the alarms;

wherein when the exterior door is opened the first alarm sounds until the exterior door is closed;

wherein when the baby is placed in the baby receiving area the second alarm sounds and when the exterior door is closed after the baby has been placed in the baby receiving area, the exterior door locks and cannot be opened until the baby is removed from the baby receiving area.

2. The system for receiving a baby of claim 1, further comprising a medical bassinet located in the baby receiving area wherein the second alarm includes an optical sensor system that projects a beam of light through the medical bassinet such that when the baby is placed in the medical bassinet, the beam of light is interrupted causing the second alarm to actuate.

3. The system for receiving a baby of claim 1, further including a visual alarm located in the interior of the building such that when the exterior door is opened and the visual alarm is activated, the visual alarm cannot be observed from the exterior door.

4. The system for receiving a baby of claim 1 wherein the multilevel alarm system further comprises either a hard-wired connection or a wireless connection to a location of the alarm monitor.

5. The system for receiving a baby of claim 1 wherein the exterior door includes an insulating layer.

6. The system for receiving a baby of claim 1, wherein the lock is an electromagnetic lock and when the beam of light is interrupted a signal is sent to the ECU and the ECU causes the electromagnetic lock to energize, the ECU further causes a second signal to be sent to the alarm monitor indicating that the baby is in the medical bassinet.

7. The system for receiving a baby of claim 6 wherein the ECU includes a software code for causing a delay in sending the second signal to the alarm monitor.

8. A system for anonymously surrendering a baby, comprising:

a receptacle defining a space at least large enough to contain a baby, the receptacle having a front, an opposing back, a top and opposing bottom;

an exterior door arranged in the front and sized to allow the baby to pass through the exterior door into the space;

a lock constructed for locking the exterior door;

a second door arranged in the back sized to allow a baby to pass through the second door and out of the receptacle, the second door having at least one ventilation opening for providing conditioned air to the receptacle;

a baby receiving area located between the front and back;

a multi-level alarm system arranged to activate when the baby is placed in the receptacle, the multi-level alarm system including a first alarm that is actuated upon opening of the exterior door, a second alarm that is actuated when the baby is placed in a medical bassinet located in the baby receiving area and a third alarm comprising a visual alarm; and an ECU for controlling at least one of the alarms;

wherein when the exterior door is opened the first alarm sounds and when the baby is placed in the medical bassinet the second alarm sounds.

9. The system for anonymously surrendering a baby of claim 8 wherein when the exterior door is closed after the baby has been placed in the baby receiving area, the exterior door locks and cannot be opened until the baby is removed from the baby receiving area.

10. The system for anonymously surrendering a baby of claim 8 wherein when either the exterior door is opened or the baby is place in the medical bassinet, the visual alarm activates such that the visual alarm cannot be seen when the baby is placed in the receptacle.

11. The system for anonymously surrendering a baby of claim 8 further comprising an optical sensor system that projects a beam of light through the medical bassinet such that when the baby is placed in the medical bassinet, the beam of light is interrupted causing the second alarm to actuate.

12. The system for anonymously surrendering a baby of claim 8 further comprising an optical sensor system that includes a photo eye and opposing reflector wherein a beam of light is projected between the photo eye and reflector and through the medical bassinet located between the photo eye and reflector and wherein when the baby is placed in the medical bassinet, the beam of light is interrupted causing the second alarm to actuate.

13. The system for anonymously surrendering a baby of claim 8 further comprising a video monitoring system to monitor the baby placed in the receptacle, the video monitoring system comprising a camera arranged in the receptacle wherein the camera begins to record when the exterior door is opened.

14. The system for anonymously surrendering a baby of claim 8 further comprising a system for controlling the temperature in the receptacle, the system comprising a fan, a heater and a thermostat, wherein at least one of the fan and the heater is turned on at a predetermined temperature.

* * * * *